US007581925B2

(12) United States Patent
Xu et al.

(10) Patent No.: US 7,581,925 B2
(45) Date of Patent: Sep. 1, 2009

(54) DIFFUSER FOR A CENTRIFUGAL COMPRESSOR

(75) Inventors: Cheng Xu, Huntersville, NC (US); Dwayne Valentine, Charlotte, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 465 days.

(21) Appl. No.: 11/531,296

(22) Filed: Sep. 13, 2006

(65) Prior Publication Data

US 2007/0059170 A1 Mar. 15, 2007

Related U.S. Application Data

(60) Provisional application No. 60/716,600, filed on Sep. 13, 2005.

(51) Int. Cl.
*F04D 29/44* (2006.01)

(52) U.S. Cl. ..... 415/211.2; 415/211.1; 415/208.2

(58) Field of Classification Search ..... 415/211.1, 415/211.2, 208.3
See application file for complete search history.

(56) References Cited

U.S. PATENT DOCUMENTS

| | | | | |
|---|---|---|---|---|
| 2,372,880 | A * | 4/1945 | Browne | 415/208.3 |
| 2,967,013 | A | 1/1961 | Dallenbach et al. | |
| 3,243,159 | A | 3/1966 | Hefler et al. | |
| 3,333,762 | A | 8/1967 | Vrana | |
| 3,489,340 | A * | 1/1970 | Holzhausen | 415/208.3 |
| 3,930,746 | A | 1/1976 | Kronogard | |
| 4,877,373 | A | 10/1989 | Bandukwalla | |
| 5,178,516 | A | 1/1993 | Nakagawa et al. | |
| 5,529,457 | A | 6/1996 | Terasaki et al. | |
| 5,595,473 | A | 1/1997 | Nagaoka et al. | |
| 5,857,834 | A | 1/1999 | Nagaoka et al. | |
| 5,971,705 | A | 10/1999 | Nagaoka et al. | |

(Continued)

FOREIGN PATENT DOCUMENTS

| | | | |
|---|---|---|---|
| DE | 19502808 | A1 | 8/1996 |

(Continued)

OTHER PUBLICATIONS

ASME Turbo Expo 2002: Land, Sea and Air, "A Turbomachinery Blade Design and Optimization Procedure," C. Xu and R.S. Amano, Jun. 3-6, 2002.

*Primary Examiner*—Ninh H Nguyen
(74) *Attorney, Agent, or Firm*—Michael Best & Friedrich LLP

(57) ABSTRACT

A diffuser for use in a centrifugal compressor that includes an impeller that discharges a high-velocity flow of fluid. The diffuser includes a platform having a blade portion and defining a substantially circular aperture. The impeller is disposed at least partially within the aperture such that the high-velocity fluid exits the impeller in directions that are substantially tangent to the blade portion. A vane extends from the platform and includes a suction side, a pressure side, and a leading edge having a platform portion and a shroud portion. A majority of the shroud portion is disposed on the suction side of a line normal to the platform that passes through a center of the platform portion of the leading edge. A shroud is coupled to the shroud portion of the vane such that the vane, the platform, and the shroud cooperate to at least partially define two flow paths.

30 Claims, 5 Drawing Sheets

U.S. PATENT DOCUMENTS

| | | | | |
|---|---|---|---|---|
| 6,139,266 | A | 10/2000 | Nagaoka et al. | |
| 6,290,460 | B1 | 9/2001 | Nagaoka et al. | |
| 6,312,222 | B1 | 11/2001 | Nagaoka et al. | |
| 6,364,607 | B2 | 4/2002 | Nagaoka et al. | |
| 6,371,724 | B2 | 4/2002 | Nagaoka et al. | |
| 6,540,481 | B2 * | 4/2003 | Moussa et al. | 415/208.2 |
| 6,755,612 | B2 | 6/2004 | Shahpar et al. | |
| 6,877,955 | B2 | 4/2005 | Higashimori et al. | |
| 6,905,307 | B2 | 6/2005 | Kawarada et al. | |
| 2001/0033792 | A1 | 10/2001 | Nagaoka et al. | |
| 2005/0005606 | A1 | 1/2005 | Vrbas et al. | |
| 2005/0163610 | A1 * | 7/2005 | Higashimori | 415/191 |

FOREIGN PATENT DOCUMENTS

| | | |
|---|---|---|
| EP | 1568891 | 8/2005 |

* cited by examiner

DIFFUSER FOR A CENTRIFUGAL COMPRESSOR

RELATED APPLICATION DATA

This application claims benefit under 35 U.S.C. Section 119(e) of U.S. Provisional Application No. 60/716,600 filed Sep. 13, 2005, which is fully incorporated herein by reference.

BACKGROUND

The invention relates to centrifugal compressors. More particularly, the invention relates to a diffuser for use in a centrifugal compressor.

Compressors are used throughout industry to compress fluids that are generally in a gaseous or vapor state. The most common types of compressors include reciprocating compressors, rotary compressors (e.g., screw, gear, scroll, etc.), and centrifugal compressors. Centrifugal compressors are generally used when a high volume of compressed fluid, such as air is required.

Centrifugal compressors employ a rapidly rotating impeller that includes a plurality of aerodynamic blades. The blades interact with the fluid being compressed to accelerate the fluid. The fluid is then discharged from the impeller at a high-velocity.

The high-velocity fluid enters a diffuser that includes aerodynamic features that act on the high-velocity flow to reduce the velocity and increase the pressure of the fluid. Because aerodynamic features are employed, inefficiencies can arise due to flow separation, vortices, eddies, and other flow phenomena. In addition, diffusers can be susceptible to choked flow and stall if operated outside of their expected design range.

SUMMARY

In one embodiment, the invention provides a diffuser for use in a centrifugal compressor that includes an impeller that discharges a high-velocity flow of fluid. The diffuser includes a platform having a blade portion and defining a substantially circular aperture. The impeller is disposed at least partially within the aperture such that the high-velocity fluid exits the impeller in directions that are substantially tangent to the blade portion. A vane extends from the platform and includes a suction side, a pressure side, and a leading edge having a platform portion and a shroud portion. A majority of the shroud portion is disposed on the suction side of a line normal to the platform that passes through a center of the platform portion of the leading edge. A shroud is coupled to the shroud portion of the vane such that the vane, the platform, and the shroud cooperate to at least partially define two flow paths.

In another embodiment, the invention provides a diffuser for use in a centrifugal compressor that includes an impeller that discharges a high-velocity flow of fluid. The diffuser includes a platform having a blade portion and defining a substantially circular aperture. The impeller is disposed at least partially within the aperture such that the high-velocity fluid exits the impeller in directions that are substantially tangent to the blade portion. A vane extends from the platform and includes a leading edge having a platform portion, a shroud portion, and a middle portion disposed between the platform portion and the shroud portion. The leading edge is curved such that the middle portion is spaced a non-zero distance from a line that extends through the platform portion and the shroud portion. A shroud is coupled to the shroud portion such that the vane, the platform, and the shroud cooperate to at least partially define two flow paths.

In another embodiment, the invention provides a diffuser for use in a centrifugal compressor that includes an impeller that discharges a high-velocity flow of fluid. The diffuser includes a platform having a blade portion and defining a substantially circular aperture. The impeller is disposed at least partially within the aperture such that the high-velocity fluid exits the impeller in directions that are substantially tangent to the blade portion. A shroud is spaced apart from the platform. A vane extends between the platform and the shroud. The vane includes a leading edge, a trailing edge, a suction side, and a pressure side. The suction side includes a platform portion, a shroud portion, and a middle portion. The middle portion is bowed toward the pressure side as compared to the platform portion and the suction portion.

In another embodiment, the invention provides a diffuser for use in a centrifugal compressor that includes an impeller that discharges a high-velocity flow of fluid. The diffuser includes a platform having a blade portion and defining a substantially circular aperture. The impeller is disposed at least partially within the aperture such that the high-velocity fluid exits the impeller in directions that are substantially tangent to the blade portion. A chamfered surface is formed as part of the platform and is disposed between the impeller and the blade portion. A shroud is spaced a non-zero distance from the platform. A plurality of vanes is coupled to the platform and to the shroud. The interface between each of the vanes and the platform defines a fillet surface. The interface between each of the vanes and the shroud defines a substantially square corner.

Other aspects and embodiments of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1:
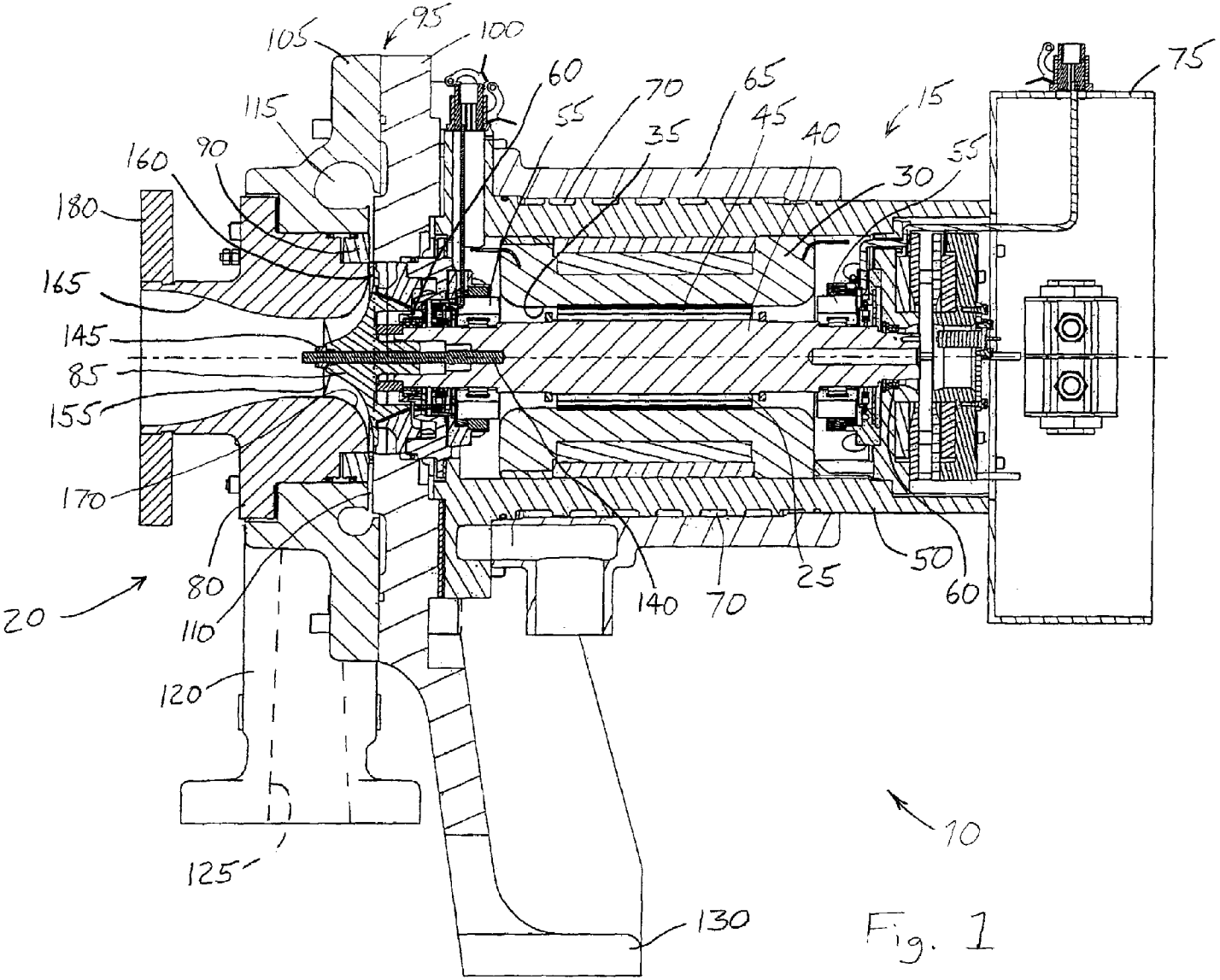
FIG. 1 is a cross-sectional view of a centrifugal compressor embodying the invention.

FIG. 1 illustrates a fluid compression system 10 that includes a prime mover, such as a motor 15 coupled to a compressor 20 and operable to produce a compressed fluid. In the illustrated construction, an electric motor 15 is employed as the prime mover. However, other constructions may employ other prime movers such as but not limited to internal combustion engines, diesel engines, combustion turbines, etc.

The electric motor 15 includes a rotor 25 and a stator 30 that defines a stator bore 35. The rotor 25 is supported for rotation on a shaft 40 and is positioned substantially within the stator bore 35. The illustrated rotor 25 includes permanent magnets 45 that interact with a magnetic field produced by the stator 30 to produce rotation of the rotor 25 and the shaft 40. The magnetic field of the stator 30 can be varied to vary the speed of rotation of the shaft 40. Of course, other constructions may employ other types of electric motors (e.g., synchronous, induction, brushed DC motors, etc.) if desired.

The motor 15 is positioned within a housing 50 which provides both support and protection for the motor 15. A bearing 55 is positioned on either end of the housing 50 and is directly or indirectly supported by the housing 50. The bearings 55 in turn support the shaft 40 for rotation. In the illustrated construction, magnetic bearings 55 are employed with other bearings (e.g., roller, ball, needle, etc.) also suitable for use. In the construction illustrated in FIG. 1, secondary bearings 60 are employed to provide shaft support in the event one or both of the magnetic bearings 55 fail.

In some constructions, an outer jacket 65 surrounds a portion of the housing 50 and defines cooling paths 70 therebetween. A liquid (e.g., glycol, refrigerant, etc.) or gas (e.g., air, carbon dioxide, etc.) coolant flows through the cooling paths 70 to cool the motor 15 during operation.

An electrical cabinet 75 may be positioned at one end of the housing 50 to enclose various items such as a motor controller, breakers, switches, and the like. The motor shaft 40 extends beyond the opposite end of the housing 50 to allow the shaft 40 to be coupled to the compressor 20.

The compressor 20 includes an intake housing 80 or intake ring, an impeller 85, a diffuser 90, and a volute 95. The volute 95 includes a first portion 100 and a second portion 105. The first portion 100 attaches to the housing 50 to couple the stationary portion of the compressor 20 to the stationary portion of the motor 15. The second portion 105 attaches to the first portion 100 to define an inlet channel 110 and a collecting channel 115. The second portion 105 also defines a discharge portion 120 that includes a discharge channel 125 that is in fluid communication with the collecting channel 115 to discharge the compressed fluid from the compressor 20.

In the illustrated construction, the first portion 100 of the volute 95 includes a leg 130 that provides support for the compressor 20 and the motor 15. In other constructions, other components are used to support the compressor 20 and the motor 15 in the horizontal position. In still other constructions, one or more legs, or other means are employed to support the motor 15 and compressor 20 in a vertical orientation or any other desired orientation.

The diffuser 90 is positioned radially inward of the collecting channel 115 such that fluid flowing from the impeller 85 must pass through the diffuser 90 before entering the volute 95. The diffuser 90 includes aerodynamic surfaces (e.g., blades, vanes, fins, etc.) arranged to reduce the flow velocity and increase the pressure of the fluid as it passes through the diffuser 90.

The impeller 85 is coupled to the rotor shaft 40 such that the impeller 85 rotates with the motor rotor 25. In the illustrated construction, a rod 140 threadably engages the shaft 40 and a nut 145 treadably engages the rod 140 to fixedly attach the impeller 85 to the shaft 40. The impeller 85 extends beyond the bearing 55 that supports the motor shaft 40 and, as such is supported in a cantilever fashion. Other constructions may employ other attachment schemes to attach the impeller 85 to the shaft 40 and other support schemes to support the impeller 85. As such, the invention should not be limited to the construction illustrated in FIG. 1. Furthermore, while the illustrated construction includes a motor 15 that is directly coupled to the impeller 85, other constructions may employ a speed increaser such as a gear box to allow the motor 15 to operate at a lower speed than the impeller 85.

The impeller 85 includes a plurality of aerodynamic surfaces or blades 150 that are arranged to define an inducer portion 155 and an exducer portion 160. The inducer portion 155 is positioned at a first end of the impeller 85 and is operable to draw fluid into the impeller 85 in a substantially axial direction. The blades 150 accelerate the fluid and direct it toward the exducer portion 160 located near the opposite end of the impeller 85. The fluid is discharged from the exducer portion 160 in at least partially radial directions that extend 360 degrees around the impeller 85.

The intake housing 80, sometimes referred to as the intake ring, is connected to the volute 95 and includes a flow passage 165 that leads to the impeller 85. Fluid to be compressed is drawn by the impeller 85 down the flow passage 165 and into the inducer portion 155 of the impeller 85. The flow passage 165 includes an impeller interface portion 170 that is positioned near the blades 150 of the impeller 85 to reduce leakage of fluid over the top of the blades 150. Thus, the impeller 85 and the intake housing 80 cooperate to define a plurality of substantially closed flow passages 175.

In the illustrated construction, the intake housing 80 also includes a flange 180 that facilitates the attachment of a pipe or other flow conducting or holding component. For example, a filter assembly could be connected to the flange 180 and employed to filter the fluid to be compressed before it is directed to the impeller 85. A pipe would lead from the filter assembly to the flange 180 to substantially seal the system after the filter and inhibit the entry of unwanted fluids or contaminates.

Figure 2:
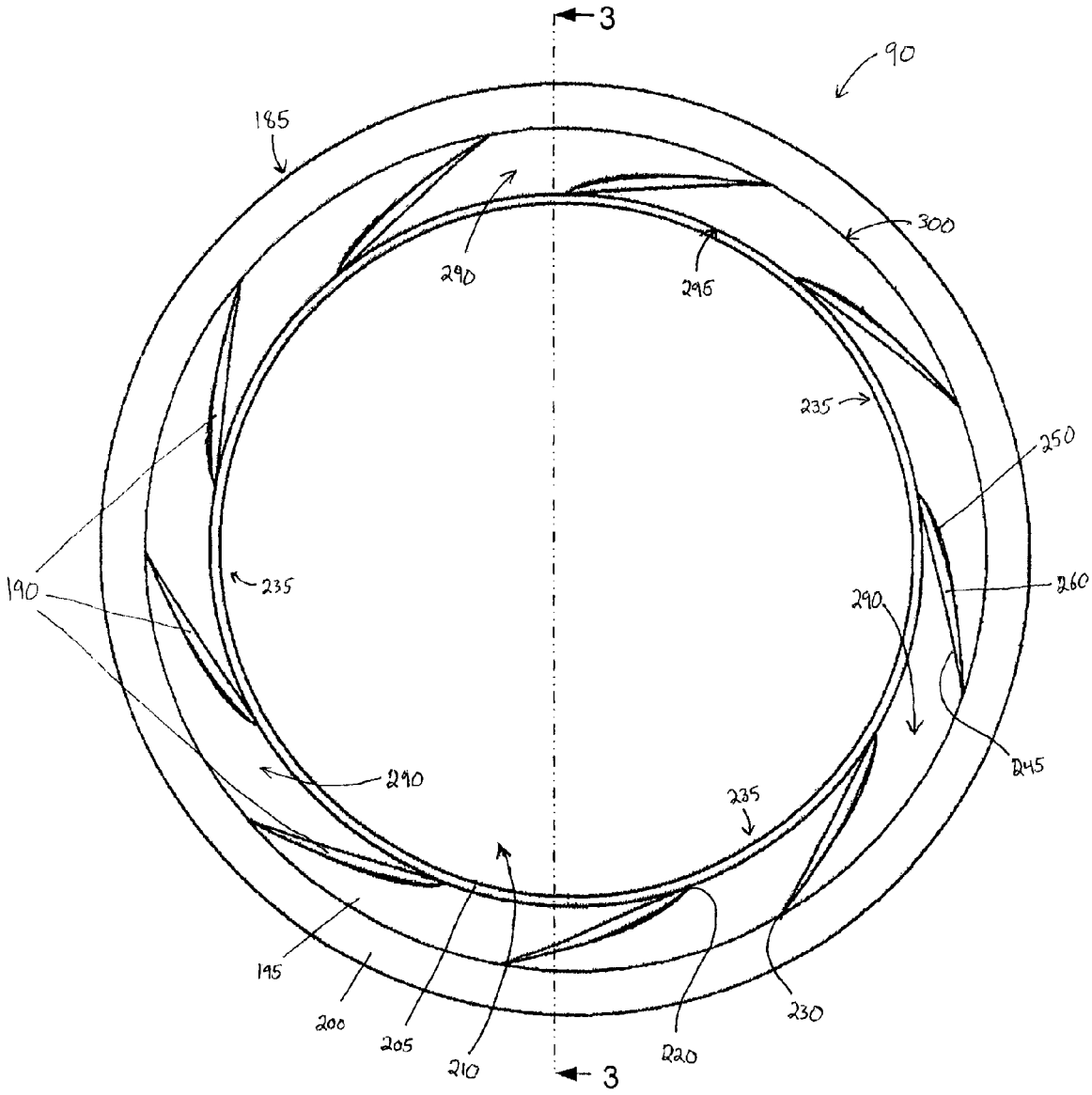
FIG. 2 is a front view of a diffuser of the centrifugal compressor of FIG. 1.

Turning to FIG. 2, the diffuser 90 is illustrated in greater detail. The diffuser 90 includes a platform 185 and a plurality of vanes 190. Other constructions may include more vanes or less vanes than the amount illustrated.

As illustrated in FIG. 2, the platform 185 includes a blade portion 195, an outlet portion 200, an inlet portion 205, and an aperture 210. The blade portion 195 supports the vanes 190 and may include a single surface (e.g., planar, conical, irregular, etc.) or multiple surfaces that interconnect to define the blade portion 195. In the construction illustrated, the blade portion 195 includes a planar surface 215, shown in FIG. 3*b*, that supports a leading edge 220 of the vanes 190 and a conical portion 225 disposed radially outward from the planar surface 215 that supports a trailing edge 230 of the vanes 190.

Figure 3A:
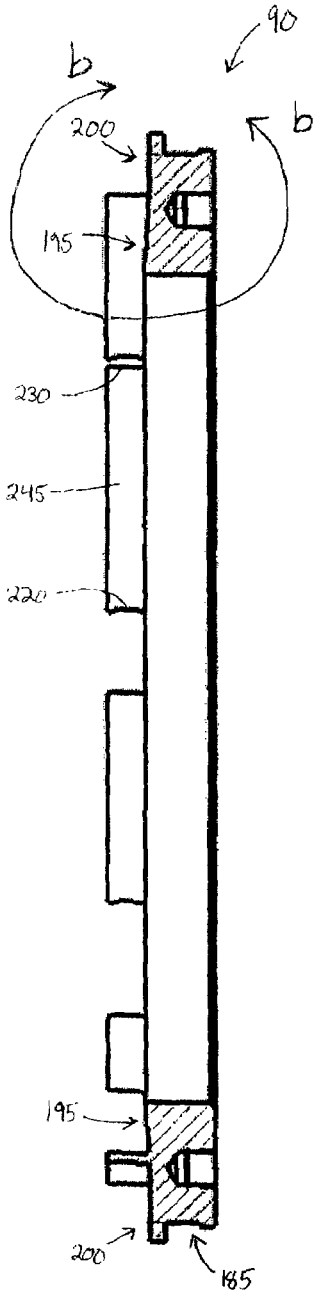
FIG. 3*a* is a cross-sectional view of the diffuser of FIG. 2 taken along line 3-3 of FIG. 2.
Figure 3B:
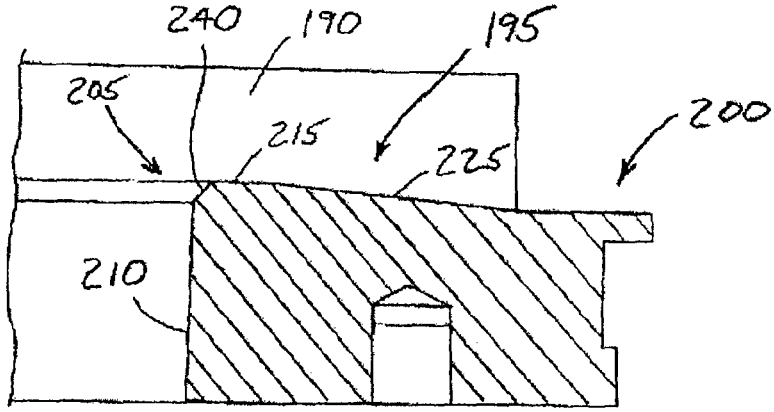
FIG. 3*b* is an enlarged view of the cross-section of FIG. 3*a* taken along curve b-b of FIG. 3*a;*

The outlet portion 200 is positioned radially outward of the blade portion 195. As illustrated in FIGS. 3*a* and 3*b*, the outlet portion 200 is substantially planar. However, other constructions could employ conical or irregular surfaces in addition to combinations of these surfaces to define the outlet portion 200.

The inlet portion 205 is disposed radially inward of the blade portion 195 and at least partially defines an inlet 235 to the diffuser 90. In the construction illustrated in FIG. 4, the inlet portion 205 includes a conical or chamfered surface 240. The chamfered surface 240 is angled at about 45 degrees with respect to a rotational axis X-X, with other angles also being possible. In still other constructions, the inlet portion 205 includes curved surfaces, multiple surfaces, and/or a combination of surfaces.

The aperture 210 is disposed adjacent the inlet portion 205 and extends through the platform 185. As such, the inlet portion 205 is a transition between the impeller 85 disposed at least partially within the aperture 210 and the diffuser 90.

The vanes 190 extend from the blade portion 195 of the platform 185 and include the leading edge 220, the trailing edge 230, a suction side 245, a pressure side 250, and a shroud portion 260. The vanes 190 are securely mounted (e.g., by welding, etc.) on the platform 185. In a preferred construction, the vanes 190 are integrally-formed as a single homogeneous component with the platform 185. In these constructions, the vanes 190 are generally machined from the same piece of material as the platform 185.

Figure 6:
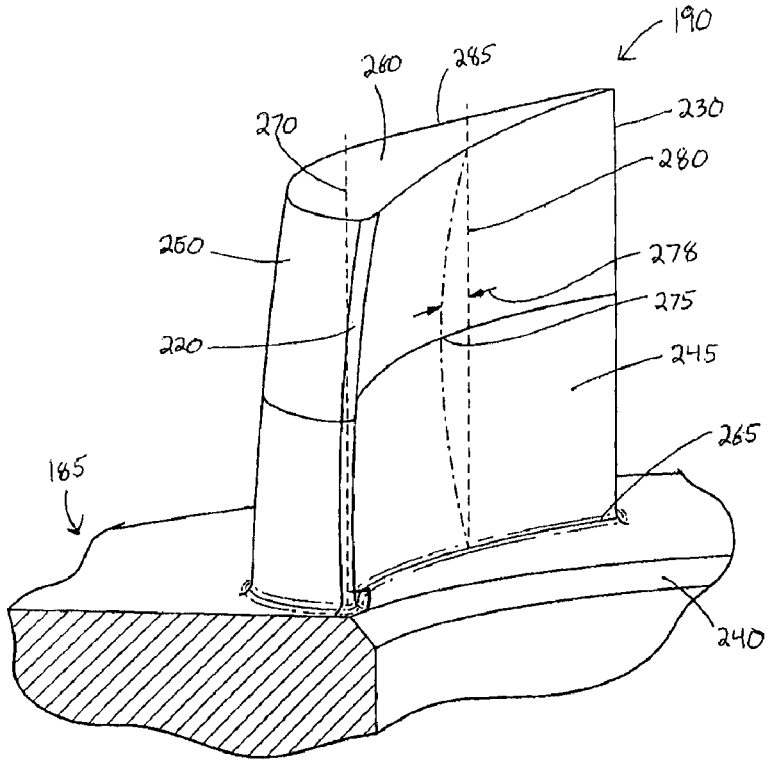
FIG. 6 is a front view of the vane of taken along line 6-6 of FIG. 5.
Figure 7:
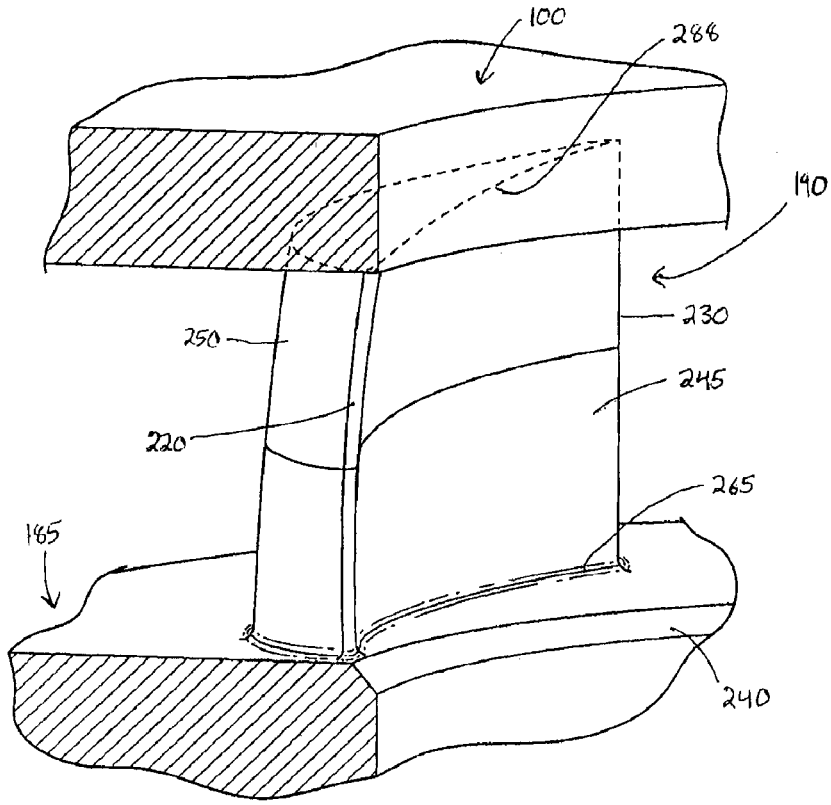
FIG. 7 is the front view of the vane of FIG. 6 coupled to a shroud.

A fillet surface 265, shown in FIGS. 6 and 7, is disposed at the interface between the vanes 190 and the platform 185 to smoothly transition from the vanes 190 to the platform 185.

Figure 5:
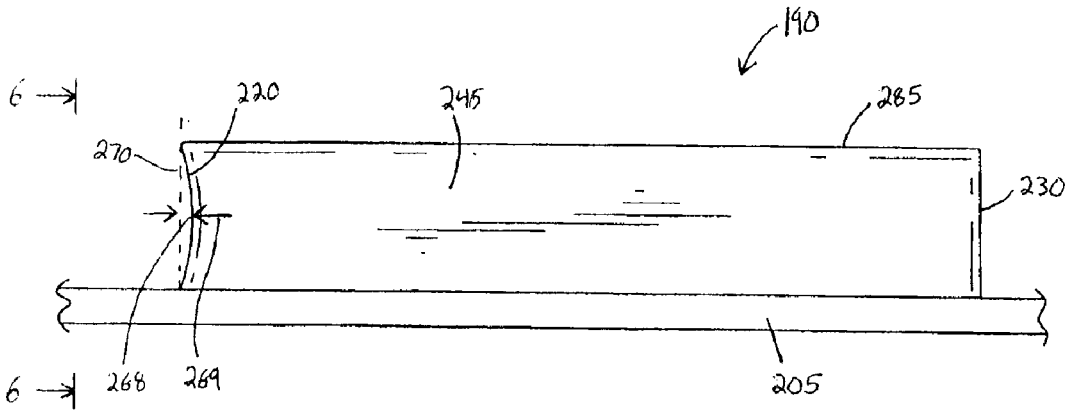
FIG. 5 is a side view of the vane of FIG. 4.

The leading edge 220 is adjacent the aperture 210 of the platform 185 and includes a cut-hack and a forward lean (i.e., the vane leans toward the incoming fluid). FIG. 5 illustrates the cut-hack of the leading edge 220. The cut-back causes a middle portion 268 of the leading edge 220 to be spaced a non-zero distance 269 from a line 270 extending between the platform 185 and the shroud portion 260. In the illustrated construction, the cut-back is a curve such that the line 270 contacts the leading edge 220 at both the platform 185 and the shroud portion 260. However, the cut-back may take other forms (e.g., linear, etc.) such that the leading edge 220 is not symmetrical.

The forward lean, as illustrated in FIG. 6, causes the shroud portion 260 of the leading edge 220 to be closer to an adjacent vane on the suction side 245 than another adjacent vane 190 on the pressure side 250. In other words, a line 270 drawn through the center of the leading edge 220 normal from the platform 185 crosses the leading edge 220 near the shroud portion 260 such that a majority of the leading edge 220 near the shroud portion 260 is on the leading or suction side of the line 270. In the construction illustrated, the forward lean is a result of a curved leading edge 220. In other constructions, the forward lean may result from a leading edge that is linear, parabolic, etc.

The trailing edge 230 is situated near the outlet portion 200 of the platform 185 and is positioned such that a vector pointing from the leading edge 220 to the trailing edge 230 generally corresponds in direction to the rotation of the impeller 85.

The suction side 245 of each of the vanes 190 is defined by a surface between the leading edge 220, the trailing edge 230, the platform 185, and the shroud portion 260 and facing the inlet portion 205. The suction side 245 is bowed toward the pressure side 250 between the platform 185 and the shroud portion 260 as shown in FIG. 6. In other words, a middle portion 275 of the vane 190 between the platform 185 and the shroud portion 260 is spaced a non-zero distance 278 from a plane that passes through a plurality of straight lines 280 (one shown) that extend from the platform 185 to the shroud portion 260 and are substantially normal to the flow of fluid through the diffuser 90.

Figure 4:
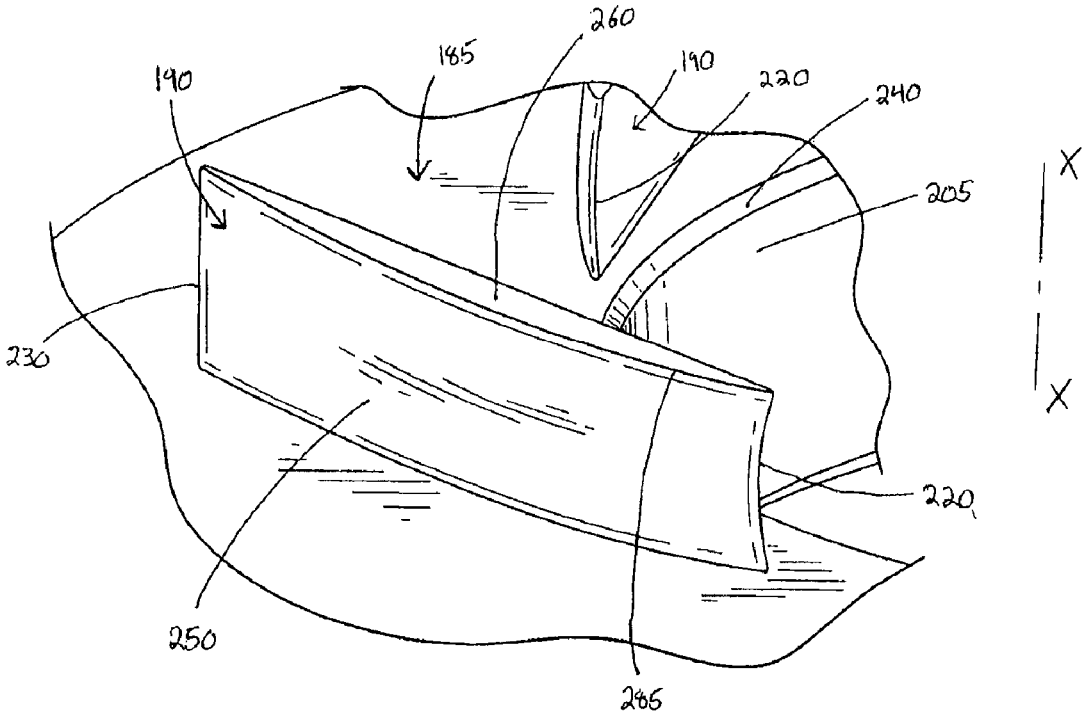
FIG. 4 is a perspective view of a vane of the diffuser of FIG. 2.

The pressure side 250 of each of the vanes 190, shown in FIG. 4, is defined by a surface between the leading edge 220, the trailing edge 230, the platform 185, and the shroud portion 260 and facing the outlet portion 200. The pressure side 250 is convex away from the suction side between the leading edge 220 and the trailing edge 230 as shown in FIG. 6. In other constructions, the pressure side 250 is not convex between the platform 185 and the shroud 100.

The shroud portion 260 is located on a surface of the vane 190 opposite the platform 185. The shroud portion 260 may be machined, molded, etc. such that the shroud portion 260 defines a sharp edge 285 along the perimeter of the vane 190. The shroud portion 260 couples to a shroud of the compressor 20, defining a substantially square corner 288 as illustrated in FIG. 7. In some constructions, the shroud is fixedly attached to the vanes 190, while other constructions include a shroud closely spaced from the vanes 190 or in contact with, but not attached to, the vanes 190. The construction illustrated in FIG. 1 uses the first portion 100 of the volute 95 as the shroud. In other constructions, the shroud may be a distinct disc not serving another purpose for the compressor 20.

A diffuser channel 290, shown in FIG. 2, is formed at each pair of adjacent vanes 190 around the diffuser 90. Each diffuser channel 290 is defined as an area between the suction side 245 of one vane 190, the pressure side 250 of an adjacent vane 190, the platform 185, and the shroud 100. Each diffuser channel 290 includes an inlet area 295 and an outlet area 300. The inlet area 295 is disposed between the leading edges 220 of two adjacent vanes 190. The outlet area 300 is disposed between the two adjacent vanes 190 near the trailing edge 230 of one of the vanes 190. The cross-sectional area of the diffuser channel 290 increases such that the outlet area 300 is greater in size than the inlet area 295.

In operation, power is provided to the motor 15 to produce rotation of the shaft 40 and the impeller 85. As the impeller 85 rotates, fluid to be compressed is drawn into the intake housing 80 and into the inducer portion 155 of the impeller 85. The impeller 85 accelerates the fluid from a velocity near zero to a high-velocity at the exducer portion 160. The fluid passes out of the impeller 85, passes over the chamfered surface 240, and enters the diffuser 90 at the inlet area 295 of the diffuser channel 290. The diffuser channel 290 maintains a guided flow pattern for the fluid that expands from the inlet area to the outlet area so as to reduce the flow velocity. The increasing cross-sectional area of the diffuser channel 290 acts to convert the dynamic energy of the flow of the fluid into potential energy or high-pressure. The now high-pressure fluid exits the diffuser 90 at the outlet area 300 of the diffuser channel 290 and enters the volute 95 via the inlet channel 110. The high-pressure fluid then passes into the collecting channel 115 which collects fluid from any angular position around the inlet channel 110. The collecting channel 15 then directs the high-pressure fluid out of the volute 95 via the discharge channel 125.

During operation, the efficiency of the compressor 20 may drop due to various undesirable flow phenomena such as flow separation, vortices, or eddies. The leading edge is cut-back and forward leaning to help reduce or minimize these phenomena.

The diffuser 90 also increases the efficiency of the compressor 20 by expanding the operational range of the compressor 20. The operational range spans from the maximum allowable stable pressure increase, above which the diffuser is susceptible to surge, to the maximum allowable flow at which the diffuser is choked. The cut back 270 of the leading edge 220 effectively increases the inlet area 295 of the diffuser channel 290, thus increasing the maximum allowable flow through the diffuser 90.

Thus, the invention provides, among other things, a new and useful diffuser 90 for use in centrifugal compressors. The constructions of the diffuser 90 described above and illustrated in the figures are presented by way of example only and are not intended as a limitation upon the concepts and principles of the invention. Various features and advantages of the invention are set forth in the following claims.

What is claimed is:

1. A diffuser for use in a centrifugal compressor including an impeller that discharges a high-velocity flow of fluid, the diffuser comprising:

a platform including blade portion and defining a substantially circular aperture, the impeller disposed at least partially within the aperture such that the high-velocity fluid exits the impeller in directions that are substantially tangent to the blade portion;

a vane extending from the platform and including a suction side, a pressure side, and a leading edge having a platform portion and a shroud portion, a majority of the shroud portion being disposed on the suction side of a line normal to the platform that passes through a center of the platform portion of the leading edge; and a shroud coupled to the shroud portion of the vane such that the vane, the platform, and the shroud cooperate to at least partially define two flow paths.

2. The diffuser of claim 1, wherein the vane is one of a plurality of substantially similar vanes, the plurality of vanes, the platform, and the shroud cooperating to define a plurality of flow paths.

3. The diffuser of claim 2, wherein each of the plurality of flow paths increases in flow area as the distance from the impeller increases.

4. The diffuser of claim 1, wherein the leading edge includes a middle portion disposed between the platform portion and the shroud portion, and the leading edge is curved such that the middle portion is spaced a non-zero distance from a line that extends through the platform portion and the shroud portion.

5. The diffuser of claim 1, wherein the vane includes a middle portion, the vane arranged such that the middle portion of the suction side is bowed toward the pressure side.

6. The diffuser of claim 1, further comprising a chamfered surface formed as part of the platform and disposed between the impeller and the blade portion.

7. The diffuser of claim 1, wherein the vane is coupled to the platform and to the shroud, and wherein the interface between the vane and the platform defines a fillet surface and the interface between the vane and the shroud defines a substantially square corner.

8. The diffuser of claim 1, wherein the vane is integrally-formed as one piece with the platform.

9. A diffuser for use in a centrifugal compressor including an impeller that discharges a high-velocity flow of fluid, the diffuser comprising:

a platform including a blade portion and defining a substantially circular aperture, the impeller disposed at least partially within the aperture such that the high-velocity fluid exits the impeller in directions that are substantially tangent to the blade portion;

a vane extending from the platform and including a leading edge having a platform portion, a shroud portion, and a middle portion disposed between the platform portion and the shroud portion, the leading edge being curved such that the middle portion is spaced a non-zero distance from a line that extends through the platform portion and the shroud portion; and a shroud coupled to the shroud portion such that the vane, the platform, and the shroud cooperate to at least partially define two flow paths.

10. The diffuser of claim 9, wherein the vane is one of a plurality of substantially similar vanes, the plurality of vanes, the platform, and the shroud cooperating to define a plurality of flow paths.

11. The diffuser of claim 10, wherein each of the plurality of flow paths increases in flow area as the distance from the impeller increases.

12. The diffuser of claim 9, wherein the vane includes a middle portion, the vane arranged such that the middle portion of the suction side is bowed toward the pressure side.

13. The diffuser of claim 9, further comprising a chamfered surface formed as part of the platform and disposed between the impeller and the blade portion.

14. The diffuser of claim 9, wherein the vane is coupled to the platform and to the shroud, and wherein the interface between the vane and the platform defines a fillet surface and the interface between the vane and the shroud defines a substantially square corner.

15. The diffuser of claim 9, wherein the vane is integrally-formed as one piece with the platform.

16. A diffuser for use in a centrifugal compressor including an impeller that discharges a high-velocity flow of fluid, the diffuser comprising:

a platform including a blade portion and defining a substantially circular aperture, the impeller disposed at least partially within the aperture such that the high-velocity fluid exits the impeller in directions that are substantially tangent to the blade portion;

a shroud spaced apart from the platform; and a vane extending between the platform and the shroud and including a leading edge, a trailing edge, a suction side, and a pressure side, the suction side including a platform portion, a shroud portion, and a middle portion, the middle portion bowed toward the pressure side as compared to the platform portion and the shroud portion.

17. The diffuser of claim 16, wherein the vane is one of a plurality of substantially similar vanes, the plurality of vanes, the platform, and the shroud cooperating to define a plurality of flow paths.

18. The diffuser of claim 17, wherein each of the plurality of flow paths increases in flow area as the distance from the impeller increases.

19. The diffuser of claim 16, wherein the leading edge includes a middle portion disposed between the platform portion and the shroud portion, and the leading edge is curved such that the middle portion is spaced a non-zero distance from a line that extends through the platform portion and the shroud portion.

20. The diffuser of claim 16, further comprising a chamfered surface formed as part of the platform and disposed between the impeller and the blade portion.

21. The diffuser of claim 16, wherein the vane is coupled to the platform and to the shroud, and wherein the interface between the vane and the platform defines a fillet surface and the interface between the vane and the shroud defines a substantially square corner.

22. The diffuser of claim 16, wherein the vane is integrally-formed as one piece with the platform.

23. A diffuser for use in a centrifugal compressor including an impeller that discharges a high-velocity flow of fluid, the diffuser comprising:

a platform including a blade portion and defining a substantially circular aperture, the impeller disposed at least partially within the aperture such that the high-velocity fluid exits the impeller in directions that are substantially tangent to the blade portion;

a chamfered surface formed as part of the platform and disposed between the impeller and the blade portion;

a shroud spaced a non-zero distance from the platform; and a plurality of vanes each coupled to the platform and to the shroud, the interface between each of the vanes and the platform defining a fillet surface and the interface between each of the vanes and the shroud defining a substantially square corner.

24. The diffuser of claim 23, wherein the plurality of vanes, the platform, and the shroud cooperate to define a plurality of flow paths.

25. The diffuser of claim 24, wherein each of the plurality of flow paths increases in flow area as the distance from the impeller increases.

26. The diffuser of claim 23, wherein each of the plurality of vanes includes a leading edge that includes a middle portion disposed between a platform portion and a shroud portion, and wherein the leading edge is curved such that the middle portion is spaced a non-zero distance from a line that extends through the platform portion and the shroud portion.

27. The diffuser of claim 23, wherein each of the plurality of vanes includes a pressure side and a suction side that includes a middle portion, the vane arranged such that the middle portion of the suction side is bowed toward the pressure side.

28. The diffuser of claim 23, further comprising a chamfered surface formed as part of the platform and disposed between the impeller and the blade portion.

29. The diffuser of claim 23, wherein each of the plurality of vanes extends from the platform and includes a suction side, a pressure side, and a leading edge having a platform portion and a shroud portion, the shroud portion being disposed on the suction side of a line normal to the platform that passes through a center of the platform portion of the leading edge.

30. The diffuser of claim 23, wherein each of the plurality of vanes is integrally-formed as one piece with the platform.

* * * * *

UNITED STATES PATENT AND TRADEMARK OFFICE

CERTIFICATE OF CORRECTION

PATENT NO. : 7,581,925 B2
APPLICATION NO. : 11/531296
DATED : September 13, 2006
INVENTOR(S) : Cheng Xu and Dwayne Valentine It is certified that error appears in the above-identified patent and that said Letters Patent is hereby corrected as shown below:

Column 6, Line 54: "channel '15'" should be --115--.

Signed and Sealed this

Twenty-third Day of March, 2010

David J. Kappos

David J. Kappos
*Director of the United States Patent and Trademark Office*